US012071593B2

(12) United States Patent
Atkins

(10) Patent No.: US 12,071,593 B2
(45) Date of Patent: Aug. 27, 2024

(54) HIGH-YIELD PITCH SYNTHESIS PROCESS FOR PRODUCING CARBON FIBER

(71) Applicant: CARBON HOLDINGS INTELLECTUAL PROPERTIES, LLC, Sheridan, WY (US)

(72) Inventor: Charles Agee Atkins, Sheridan, WY (US)

(73) Assignee: CARBON HOLDINGS INTELLECTUAL PROPERTIES, LLC, Ranchester, WY (US)

( * ) Notice: Subject to any disclaimer, the term of this patent is extended or adjusted under 35 U.S.C. 154(b) by 0 days.

(21) Appl. No.: 16/827,346

(22) Filed: Mar. 23, 2020

(65) Prior Publication Data

US 2020/0299589 A1 Sep. 24, 2020

Related U.S. Application Data

(60) Provisional application No. 62/821,814, filed on Mar. 21, 2019.

(51) Int. Cl.

| | |
|---|---|
| ***D01F 9/15*** | (2006.01) |
| ***C10G 1/00*** | (2006.01) |
| ***C10G 1/08*** | (2006.01) |

(52) U.S. Cl.

CPC ..... *C10G 1/008* (2013.01); *C10G 1/083* (2013.01); *D01F 9/15* (2013.01)

(58) Field of Classification Search

None

See application file for complete search history.

(56) References Cited

U.S. PATENT DOCUMENTS 3,488,278 A * 1/1970 Nelson ..... C10G 1/083 208/408
3,527,691 A * 9/1970 Hodgson ..... C10G 1/083 208/419

(Continued)

FOREIGN PATENT DOCUMENTS

JP S537533 A 1/1978
JP S5386717 A 7/1978

(Continued)

OTHER PUBLICATIONS

International Search Report and Written Opinion received for International Application No. PCT/US2020/024282, mailed on Jul. 30, 2020, 17 pages.

*Primary Examiner* — Tam M Nguyen
(74) *Attorney, Agent, or Firm* — Dorsey & Whitney LLP

(57) ABSTRACT

Systems and methods of processing coal to form mesophase pitch include performing a low-severity direct coal liquefaction (LSDCL) process on a coal feedstock to produce a coal tar pitch therefrom. The systems and methods can include contacting coal directly with a catalyst in the presence of a solvent, pressurizing the coal in direct contact with the catalyst in the presence of the solvent to a predetermined pressure of about 1000 psia or less, heating the coal in direct contact with the catalyst in the presence of the solvent to a predetermined temperature of about 380° C. or less, and liquefying the coal to form a coal tar pitch. The coal tar pitch can be thermally treated to a liquid crystal phase exhibiting anisotropic spheres of mesophase and spun to form carbon fibers.

9 Claims, 6 Drawing Sheets

(56) References Cited

U.S. PATENT DOCUMENTS

| | | | | |
|---|---|---|---|---|
| 4,019,975 | A * | 4/1977 | Urquhart | C10G 1/083 208/405 |
| 4,148,709 | A * | 4/1979 | Sze | C10G 1/083 208/415 |
| 4,272,501 | A * | 6/1981 | Greskovich | D01F 9/15 423/447.1 |
| 4,354,919 | A | 10/1982 | Oi et al. | |
| 4,590,055 | A | 5/1986 | Yamada et al. | |
| 9,074,154 | B2 | 7/2015 | Taylor | |
| 2012/0076703 | A1 | 3/2012 | Stiller et al. | |
| 2017/0321125 | A1* | 11/2017 | Bauman | C10G 1/065 |
| 2018/0362423 | A1* | 12/2018 | Ferrando | D21C 5/00 |
| 2018/0368343 | A1* | 12/2018 | O'Rourke | C12M 43/08 |
| 2020/0299587 | A1* | 9/2020 | Atkins | C10B 53/04 |

FOREIGN PATENT DOCUMENTS

| | | | |
|---|---|---|---|
| JP | S5386718 | A | 7/1978 |
| JP | S54160427 | A | 12/1979 |
| JP | S5558287 | A | 4/1980 |
| JP | S55130809 | A | 10/1980 |
| JP | 4528013 | B2 | 6/2010 |
| JP | 4908634 | B2 | 1/2012 |
| WO | 2019133539 | A1 | 7/2019 |

* cited by examiner

HIGH-YIELD PITCH SYNTHESIS PROCESS FOR PRODUCING CARBON FIBER

CROSS REFERENCE TO RELATED APPLICATIONS

This application claims priority to U.S. Provisional Application No. 62/821,814 filed on 21 Mar. 2019, the disclosures of which are incorporated herein, in their entirety, by this reference.

FIELD

The described embodiments relate generally to carbon based processing methods. More particularly, the present embodiments relate to systems and methods for using low-severity direct coal liquefaction techniques to convert coal to coal tar pitch, mesophase pitch, and/or carbon fibers.

BACKGROUND

As is well known, for example in U.S. Pat. No. 4,590,055, the carbon fibers currently produced and widely used are classified into two categories according to the starting material, i.e. the PAN (polyacrylonitrile)-based carbon fibers prepared by the carbonization of polyacrylonitrile fibers and the pitch-based carbon fibers prepared from pitches of coal- or petroleum-origin.

Despite the advantages of the pitch-based carbon fibers due to their inexpensiveness, the PAN-based carbon fibers occupy the major current of the industrial high-performance carbon fibers having high mechanical strength and high modulus suitable for reinforcing various composite materials. This is partly due to the tensile strength of the pitch-based carbon fibers being industrially produced being relatively low and limited to 200 kg/mm$^2$ or below.

Various attempts have been made to develop high-performance carbon fibers starting from inexpensive pitch compositions. The properties of the starting pitch is one of the most important factors for obtaining high-performance pitch-based carbon fibers. Recently, several proposals have been made for preparing a pitch composition suitable for forming high-performance carbon fibers, including (a) a method in which a specific condensed polycyclic aromatic compound is subjected to a heat treatment or treatment in hydrogen (see, for example, Japanese Patent Publication Nos. 45-28013 and 49-8634); (b) a method in which a mesophase pitch is obtained by subjecting a tar or pitch of petroleum origin to a first heat treatment in the presence of a Lewis acid catalyst followed by a second heat treatment after removal of the catalyst (see, for example, Japanese Patent Publication No. 53-7533); (c) a method in which a mesophase pitch having a desired mesophase content is obtained by the heat treatment of a pitch in an atmosphere of a flowing inert gas or under a reduced pressure (see, for example, Japanese Patent Kokai Nos. 53-86717 and 53-86718); and (d) a method in which an optically isotropic pitch is subjected to a treatment with an organic solvent, e.g. benzene, toluene, and heptane, and the insoluble fraction is heated to form neomesophase (see, for example, Japanese Pat. Nos. Kokai 54-160427, 55-58287 and 55-130809).

Unfortunately, the above described methods are not effective enough to result in a pitch composition suited for the formation of high-performance carbon fibers having a tensile strength comparable to the PAN-based carbon fibers. Therefore, the actual application of carbon fibers prepared from an isotropic pitch is limited to those fields in which particularly high tensile strength is not required, such as reinforcement in asbestos substitutes. The mesophase pitch produced in some of the above described methods are limited in practical manufacturing processes due to their relatively high viscosity and poor spinnability, causing a difficulty in melt spinning at an economically feasible velocity. Consequently, it is desirable to provide a more economical method for producing coal based mesophase pitch for the production of carbon fibers with sufficiently high tensile strength.

SUMMARY

According to one aspect of the present disclosure, a method of processing coal includes contacting an amount of coal directly with a catalyst in the presence of a solvent, exerting a predetermined pressure of about 1000 pounds per square inch absolute (psia) or less on the amount of coal and the solvent, heating the amount of coal and the solvent to a predetermined temperature of about 380° C. or less, and liquefying at least some of the amount of coal to form a coal tar pitch.

According to another aspect of the present disclosure, a coal processing system includes a direct liquefaction reactor and a controller. The direct liquefaction reactor comprises a chamber configured to directly contact coal with a catalyst in the presence of a solvent. The controller is coupled to the direct liquefaction reactor and configured to cause the direct liquefaction reactor to pressurize the coal in direct contact with the catalyst in the presence of the solvent to a predetermined pressure of about 1000 psia or less. The controller also is configured to cause the direct liquefaction reactor to heat the coal in direct contact with the catalyst in the presence of the solvent to a predetermined temperature of about 380° C. or less. The controller is also configured to cause the direct liquefaction reactor to liquefy the coal to form a coal tar pitch. This process can be performed on a continuous basis to feed a plant sized manufacturing facility producing carbon products such as, but not limited to, graphene, fullerene, diamond, and/or carbon fiber.

According to another aspect of the present disclosure, a controller for operating a direct liquefaction reactor includes a processor and a memory. The memory is coupled to the processor and contains computer-executable instructions that, when executed by the processor, cause the controller to operate the direct liquefaction reactor to pressurize coal in direct contact with a catalyst in the presence of a solvent in the direct liquefaction reactor to a predetermined pressure of about 1000 psia or less. When executed by the processor, the computer-executable instructions also cause the controller to operate the direct liquefaction reactor to heat the coal in direct contact with the catalyst in the presence of the solvent in the direct liquefaction reactor to a predetermined temperature of about 380° C. or less. When executed by the processor, the computer-executable instructions also cause the controller to operate the direct liquefaction reactor to liquefy the coal to form a coal tar pitch.

According to some aspects of the present disclosure, a vertically integrated continuous manufacturing process transforms raw coal feedstock into pitch and carbon products such as, but not limited to, graphene, fullerene, diamond, and/or carbon fiber. In one embodiment, a high-quality carbon fiber precursor material can be formed using low-severity direct coal liquefaction (LSDCL) processes in the synthesis of coal tar pitch. These techniques can dramatically increase coal tar pitch yields, especially from low-cost western U.S. coals which have not historically yielded high amounts of suitable coal tar pitch by other conventional means.

An LSDCL technique can be used as a continuous process to synthesize coal-tar-derived pitch. Once formed, the coal-tar-derived pitch can be qualitatively evaluated for use as a mesophase pitch to produce carbon products such as, but not limited to, graphene, fullerene, diamond, and/or carbon fiber and can be converted to mesophase pitch and to carbon fibers or other carbon products, as described herein.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the present disclosure, wherein identical reference numerals refer to identical or similar elements or features in different views or embodiments shown in the drawings.

DETAILED DESCRIPTION

The present description provides examples, and is not limiting of the scope, applicability, or configuration set forth in the claims. Thus, it will be understood that changes can be made in the function and arrangement of elements discussed without departing from the spirit and scope of the disclosure, and various embodiments can omit, substitute, or add other procedures or components, as appropriate. For instance, methods described can be performed in an order different from that described, and various steps can be added, omitted, or combined. Also, features described with respect to some embodiments can be combined in other embodiments.

Direct coal liquefaction (DCL) involves contacting coal directly with a catalyst at elevated temperatures and pressures with added hydrogen ($H_2$), in the presence of a solvent to form a raw liquid product which can be further refined into products such as liquid fuels. DCL is termed "direct" because the coal is transformed into liquid without first being gasified to form syngas (which can then in turn be transformed into liquid products). The latter two-step approach, i.e. the coal-to-syngas-to-liquids route is termed indirect coal liquefaction (ICL). Therefore, the DCL process is, in principle, the simpler and more efficient of the two processes. DCL can, however, require an external source of $H_2$, which may have to be provided by gasifying additional coal feed, biomass, and/or the heavy residue produced from the DCL reactor. The DCL process results in a relatively wide hydrocarbon product range consisting of a variety of molecular weights and forms, with aromatics dominating. Accordingly, the product can require substantial upgrading to yield desirable products.

The DCL process can involve adding hydrogen (hydrogenation) to the coal, breaking down the organic structure of the coal into soluble products. The reaction in DCL is carried out at elevated temperature and pressure (e.g., 750° F. to 850° F. (about 399° C. to about 454° C.) and 1,000 to 2,500 psia) in the presence of a solvent. The solvent is used to facilitate coal extraction and the addition of hydrogen. The solubilized products, including mainly aromatic compounds, may then be upgraded by conventional petroleum refining techniques, such as hydrotreating, to meet final liquid product specifications.

Figure 1A:
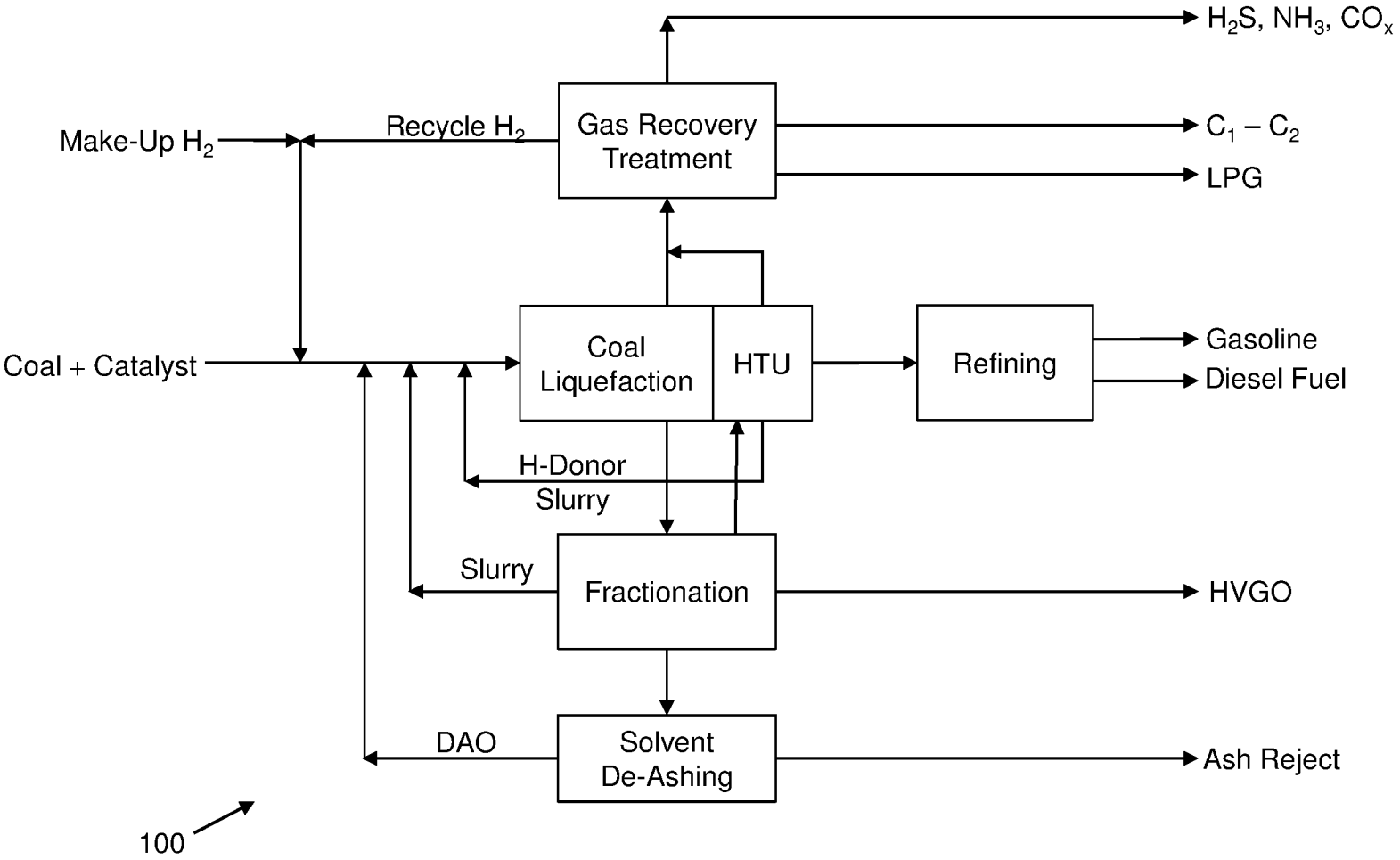
FIG. 1A is a schematic flow diagram of a direct coal liquefaction plant.

FIG. 1A shows a block flow diagram of a typical DCL plant 100 showing a hydrotreating unit (HTU) immediately downstream of the direct liquefaction reactor, to upgrade the distillate product as it is being produced. The DCL processes are generally classified into two main groups: a single-stage versus a two-stage direct liquefaction process.

One aspect of the present disclosure relates to the development and production of high-quality precursor material sourced from coal for forming carbon products such as, but not limited to, graphene, fullerene, diamond, and/or carbon fiber. In some examples, these processes for producing high-quality carbon product precursor material from coal can significantly lower the production cost of the resulting carbon products. In some examples, the processes described herein are based on low-severity direct coal liquefaction (LSDCL) techniques. These techniques can be used in the synthesis of coal tar pitch to dramatically increase coal tar pitch yields, especially from low-cost western United States coals which heretofore have not historically yielded high amounts of suitable coal tar pitch by other conventional means, such high or low temperature pyrolysis. According to some examples, an LSDCL process is used as a continuous process to synthesize coal-tar-derived pitch, targeted for use as a carbon product precursor in a plant based manufacturing configuration.

The drive in demand for carbon based products, such as carbon fiber and carbon fiber reinforced polymers, is driven at least partially by weight and performance benefits of carbon based products, such as carbon fiber and carbon fiber reinforced polymers. Demand for carbon based products such as carbon fiber is only expected to increase, and cost analyses show that carbon fiber costs are most sensitive to utility and precursor prices. Precursor materials used to produce carbon fibers include rayon, pitch (coal-derived and petroleum-derived) and polyacrylonitrile (PAN). PAN has more than 96% of the CF market due to cost-effectiveness and the quality of the fiber produced.

Figure 1B:
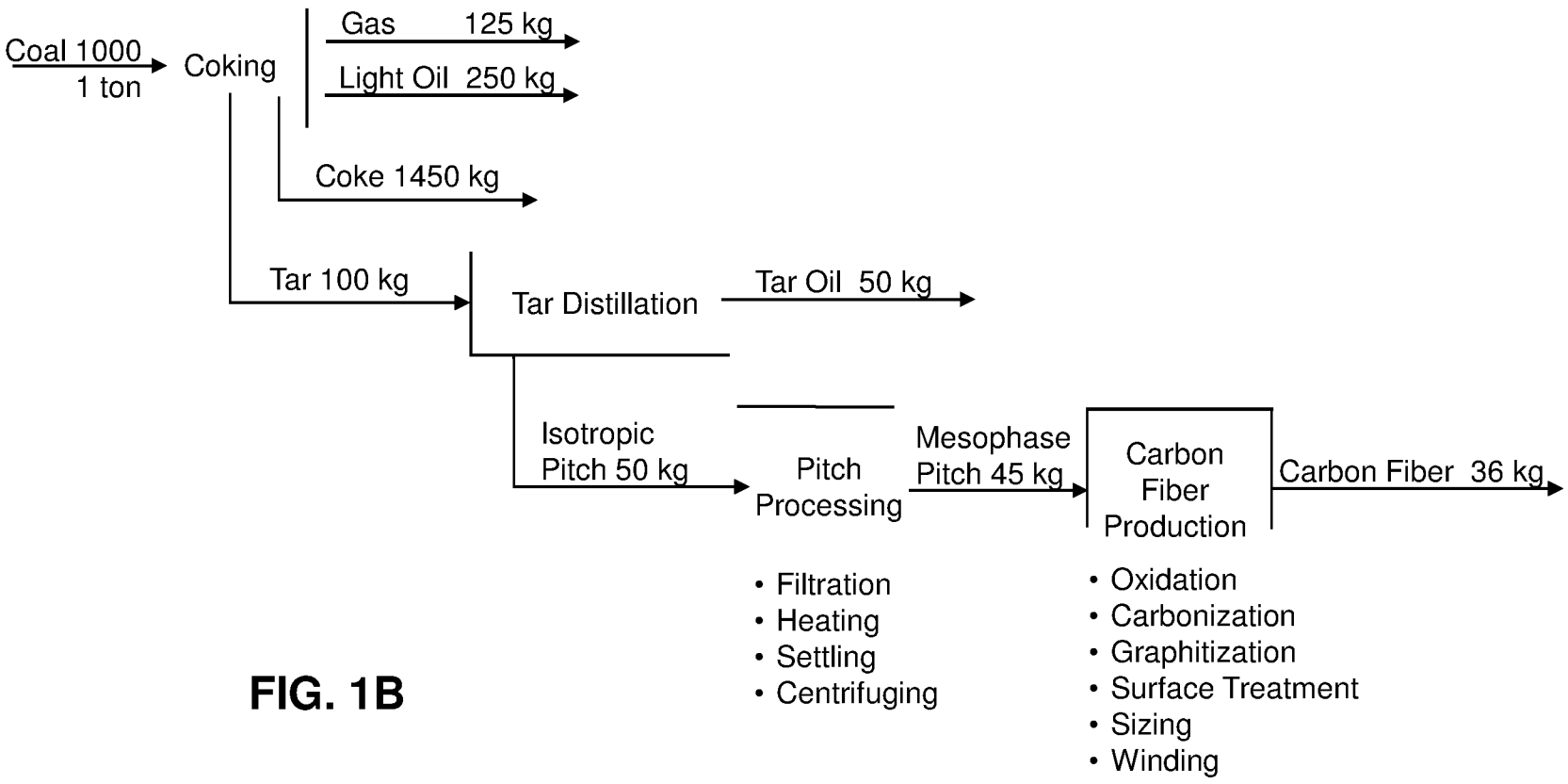
FIG. 1B is a process flow diagram showing example yields for coking of coal and production of carbon fiber from coal tar pitch.

Coal is the cheapest and most abundant source of carbon in the United States, and therefore has largely unexploited potential to provide the most economic source of carbon fiber precursor. Carbon fiber production from coal today is based on coal tar pitch derived for coking of coal. FIG. 1B shows typical yields for coking of coal and production of carbon fiber from the coal tar pitch. Producing 1 ton of carbon fiber typically requires 28 tons of coal. In typical coal coking operations, the yield of coal tar is only about 100 kg per ton of coal. The coal tar is about 50% pitch, or 50 kg. After pitch processing and carbon fiber production, the net carbon fiber yield is 36 kg per ton of coal.

According to some examples, the systems and methods described herein provide for the direct conversion of coal to a precursor suitable for producing carbon fiber. The exemplary systems and methods maximize the yield of carbon fiber from coal via direct coal liquefaction. Traditional development of DCL systems and processes has been directed towards the production of liquid transportation fuels, with high levels of hydrogenation in order to increase the H/C atomic ratio the liquid fuels produced. However, the present exemplary systems develop and demonstrate a LSDCL process with maximum yield of carbon fiber feed precursor. Table 1 provides a brief comparison between some characteristics of conventional DCL process and an example LSDCL process according the present disclosure.

TABLE 1

| Properties | DCL | LSDCL |
|---|---|---|
| Solvent:MAF Coal Feed Ratio | Base | Base |
| Space Velocity (ton coal/hr/m3 reactor volume) | Base | 2 * Base |
| Reaction Temperature, ° C. | Base | Base - 25 |
| Pressure, bar | Base | Base/3 |
| Yield, W % MF Sub-bituminous coal | DCL | Low-Severity |
| H2S/NH3/H2O/COx | 20.4 | 18.3 |
| C1-C3 | 8.6 | 3.0 |
| Distillate | 57.9 | 16.8 |
| Carbon Fiber Precursor (Pitch) | 4.0 | 37.7 |
| Quinoline Insoluble | 16.4 | 26.5 |
| Total (100 + H2 Consumption) | 107.3 | 102.3 |

According to some examples, a LSDCL process may include a continuous pilot unit using a LSDCL process concept. As shown in Table 1, the LSDCL process can double the reactor through-put relative to a DCL process, at a 25° C. lower operating temperature and at one-third the operating pressure. With the LSDCL process conditions, the product selectivity can be dramatically altered, increasing the yield of carbon fiber precursor (pitch) by an order of magnitude.

Figure 2:
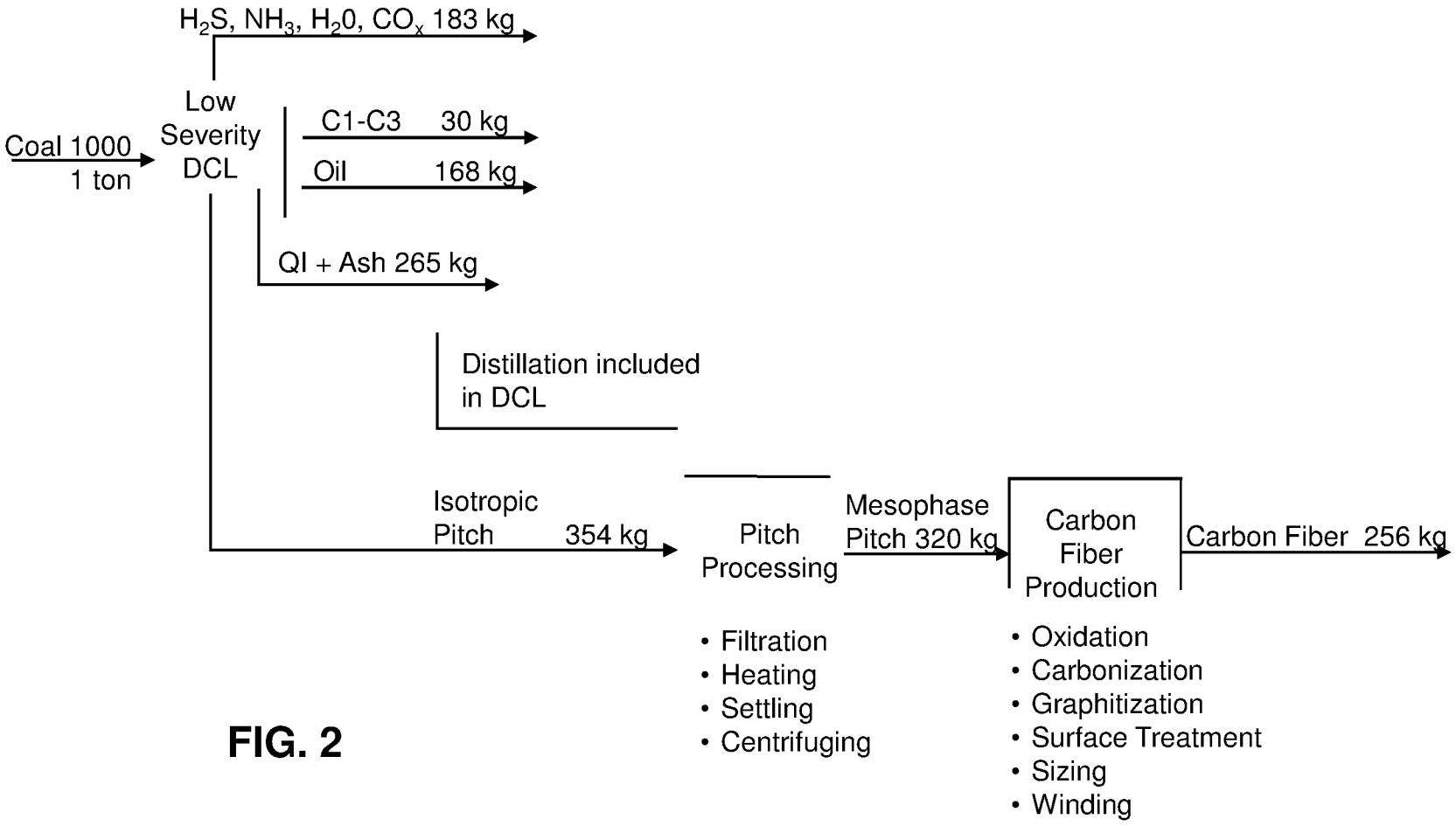
FIG. 2 is a process flow diagram illustrating an expected yield of carbon fiber by using low-severity direct coal liquefaction, according to some examples.

FIG. 2 is a block flow diagram that illustrates the expected yield of carbon fiber by using an LSDCL process as described herein. Each ton of carbon fiber produced requires only 4 tons of coal. The LSDCL processes described herein are coal-fed processes to produce high carbon fiber yield. In some examples, these LSDCL systems and processes can replace the current high-cost carbon fiber precursors (primarily polyacrylonitrile—PAN) with a low-cost, coal-derived alternative.

Many systems and methods described herein convert raw coal to high quality, high-value and marketable carbon fiber or other carbon based products. More specifically, many systems and methods described herein significantly improve the selectivity and yield of carbon fiber produced per ton of coal over conventional coal pitch-based production by using a low-severity direct coal conversion technology to maximize the yield of pitch from coal, suitable for production of carbon fiber or other carbon based products.

According to one exemplary embodiment, an LSDCL process is used and includes the following activities, which may or may not be sequential: a coal/conversion screening; a feedstock production; and a carbon fiber production. In the coal/conversion screening, a selected coal feedstock is tested for reactivity in an autoclave reactor system to first assess reactivity over a standard reactivity matrix. Additional testing can be done at different, lower severities to optimize the coal conversion and product selectivity of a feedstock most suitable for production of carbon fiber. In the feedstock production, a continuous pilot unit can be operated based on the coal/conversion screening results, at optimized conditions, representative of anticipated commercial scale operating conditions, or at commercial scale operating conditions, to produce adequate quantities of feedstock to produce carbon fibers or other carbon based products. In the carbon fiber production, the feedstock produced in the continuous pilot unit operation can be processed to produce carbon fibers. Each of these activities that can be used to perform the direct coal liquefaction process is now described in greater detail below.

Coal/Conversion Screening

Figure 3:
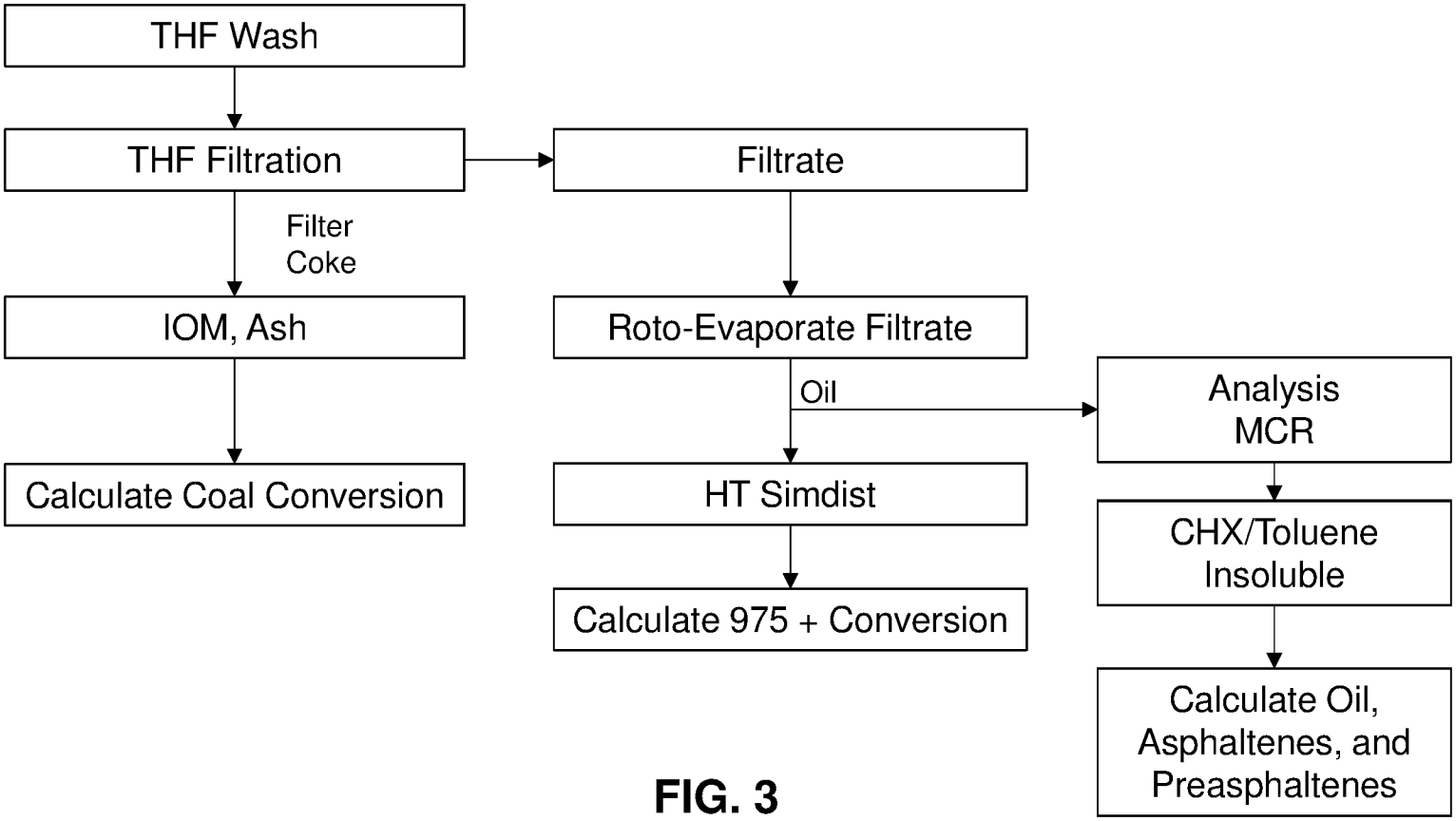
FIG. 3 is a flowchart of a micro-autoclave product work-up or analysis, according to some examples.

An example step of coal/conversion screening describes the process for coal conversion testing in a 20-cc micro-autoclave test unit, although substantially any autoclave or heating apparatus can be used, as desired. The purpose of this testing can be to assess the reactivity of coal, such as specific types, ranks, or other forms of coal, at standard and non-standard test conditions. As shown in Table 3.1, a preliminary test plan can include a matrix of micro-autoclave tests at 3 temperatures (750° F., 800° F., and 825° F.) and 3 times (15, 30 and 45 minutes). This can be a standard test matrix that has been extensively used previously for coal reactivity characterization. Two additional matrices can be performed at lower severity on the actual coal reactivity and process performance requirements (15 tests total). The lower severity matrices can study pressure, temperature and time variables. Table 3.2 shows the example coal feed analysis requirements, and Table 3.3 is an example analysis of the donor solvent to be used onsite. The donor solvent was prepared via hydrogenation of coal-derived anthracene oil, although substantially any donor solvent and method of preparation can be used. The solvent can be selected, and in some examples, 3.5 weigh percent (wt %) tetralin can be added to the solvent as desired. FIG. 3 is a flowchart of an example micro-autoclave product work-up/analysis. The micro-autoclave reactor can be thoroughly washed with THF (Tetrahydrofuran) to remove all of the contents of the reactor. The THF wash material can be filtered to recover a filter cake. The filter cake can then be analyzed to determine ash and TOM (Insoluble Organic Matter) in order to calculate coal conversion. The THF is evaporated from the filtrate to recover the oil product and analyzed by TGA to determine 975 F+ content in order to calculate 975 F+ conversion. The oil product can be analyzed for MCR, CHX (cyclohexane) and toluene insoluble contents.

TABLE 3.1

| Coal Feed - 2 g/Solvent - 8 g/2,000 psia $H_2$ | | | |
|---|---|---|---|
| | Temp | | |
| Time | 750° F. | 800° F. | 825° F. |
| 15 minutes | | x | |
| 30 minutes | x | x | x |
| 45 minutes | | x | |

TABLE 3.2

| Proximate Analysis | | |
|---|---|---|
| Moisture | W % | x |
| Volatile Matter | W % | x |
| Fixed Carbon | W % | x |
| Ash | W % | x |
| Ultimate Analysis | | |
| Carbon | W % | x |
| Hydrogen | W % | x |
| Nitrogen | W % | x |

TABLE 3.2-continued

| | | |
|---|---|---|
| Sulfur | W % | x |
| Ash | W % | x |
| Oxygen (by difference) | W % | x |
| Sulfur Forms | | |
| Sulfate | W % | x |
| Pyritic | W % | x |
| Organic (by difference) | W % | x |

TABLE 3.3

| | Batch ID | | | |
|---|---|---|---|---|
| | L-1379 | L-1380 | L-1381 | L-1382 |
| Donor Solvent Analysis | | | | |
| API | 13.1 | 13.4 | 13.7 | 13.5 |
| Carbon, W % | 87.70 | 87.73 | 87.83 | 88.13 |
| Hydrogen, W % | 10.69 | 10.66 | 10.79 | 10.66 |
| Sulfur, W % | 0.0133 | 0.0117 | 0.0116 | 0.0112 |
| Nitrogen, W % | 0.0048 | 0.0034 | 0.0028 | 0.0036 |
| Oxygen, W % | 1.59 | 1.59 | 1.37 | 1.20 |
| Low Temp SimDis, deg F. | | | | |
| IBP | 181.4 | 180.8 | 180.2 | 180.2 |
| 10 m % | 439.8 | 432.8 | 434.6 | 428.4 |
| 30 m % | 512.4 | 510.4 | 510.8 | 508.6 |
| 50 m % | 570.0 | 568.0 | 568.0 | 567.2 |
| 70 m % | 595.2 | 593.2 | 593.2 | 589.8 |
| 90 m % | 673.4 | 665.4 | 664.8 | 660.0 |
| FBP | 887.8 | 878.2 | 883.2 | 862.0 |

Feedstock Production

Sample quantities of feedstock can be produced and tested to evaluate the yield and mechanical properties of carbon fibers derived from the feedstock. In some examples, the same methods used to produce sample quantities of feedstock can then be used to produce any quantity of feedstock, as desired. Further, the parameters of the feedstock production processes can be adjusted based on the sample feedstock produced in order to obtain feedstock having desired properties. The product work-up includes the pressure filtration and batch vacuum. Operating conditions can be based on prior development work and micro-autoclave testing results. Subsequent operating conditions can be based on feedstock analysis to produce feedstock having desired properties. In some examples, a single coal feed can be used at a single set of operating conditions for continuous operation. The solvent used in the testing can be the same as that used in the micro-autoclave testing. With respect to the feedstock production, Table 4.1 provides a Daily Analysis Required of Pilot Plant Products, Table 4.2 provides an Analysis of TBP Products, and Table 4.3 provides Analytical Methods used.

TABLE 4.1

| Daily Analysis Required of Pilot Plant Products | | | | |
|---|---|---|---|---|
| | Vent Gas | SOH | PFL | PFC |
| Detailed Daily Analysis | | | | |
| GC Gas Analysis | x | | | |
| Carbon | | x | x | x |
| Hydrogen | | x | x | x |
| Nitrogen | | x | x | x |
| Sulfur | | x | x | x |
| Oxygen | | x | x | x |
| Density | | x | x | |

TABLE 4.1-continued

| Daily Analysis Required of Pilot Plant Products | | | | |
|---|---|---|---|---|
| | Vent Gas | SOH | PFL | PFC |
| Conradson Carbon Residue | | | x | x |
| Toluene Insoluble | | | x | x |
| Quinoline Insoluble | | | | x |
| Ash | | | | x |
| Distillation | | x | x | |
| Reduce Daily Analysis | | | | |
| GC Gas Analysis | x | | | |
| Density | | x | x | |
| Conradson Carbon Residue | | | x | |
| Toluene Insoluble | | | x | x |
| Quinoline Insoluble | | | | x |
| Ash | | | | x |
| Analytical requirements | | | | |
| Detailed Daily Analysis | 8 | | | |
| Reduced Daily Analysis | 7 | | | |
| Total | 15 | | | |

TABLE 4.2

| Analysis of TBP Products (1-period) | | | |
|---|---|---|---|
| Properties | Naphtha (IBP - 180° C.) | Diesel (180-400° C.) | Heavy Oil (400° C.+) |
| Density, @15° C., kg/L | x | x | X (15/20° C.) |
| Carbon, wt % | x | x | x |
| Hydrogen, wt % | x | x | x |
| Sulfur, ppmwt | x | x | x |
| Nitrogen, ppmwt | x | x | x |
| Distillation | x | x | x |
| Viscosity, cSt | | | x (50/100° C.) |
| GC Composition | x | | |
| ICP metals analysis, ppmwt | | | x |
| Bromine number, gBr/100 g | x | x | |
| Refractive Index | | x | |
| Distillation | x | x | x |
| Pour Point | | | x |

TABLE 4.3

| Analysis | Method |
|---|---|
| Elemental Analysis | |
| Carbon | ASTM D5291 |
| Hydrogen | ASTM D5291 |
| Nitrogen | ASTM D5291 (w % level) or D4629 (ppm level) |
| Sulfur | ASTM D5016 (w % level) or D5453 (ppm level) |
| Oxygen | Calculated by difference |
| Ash, W % | ASTM D482 |
| Metals, wppm | ICP |
| MCR, W % | ASTM D-4530 |
| API Gravity | ASTM D4052 |
| Simulated Distillation, C | ASTM D2887, ASTM D6352 |
| TBP Distillations | D-86, D-1160, D2887, TBP |
| Insolubles | |
| Toluene | ASTM D473 |
| THF/Quinoline | HTI Method |
| Viscosity | ASTM D446 |

TABLE 4.3-continued

| Analysis | Method |
|---|---|
| Bromine # | ASTM D1159 |
| Pour Point, C | ASTM D97 |
| GC-MS | ASTM D6839(Naphtha), D2425(Diesel) & D2549 (Heavy Oil) |

Carbon Fiber Formation Testing

Testing of a mesophase to carbon pitch conversion process can be accomplished via a Thermo Scientific HAAKE MiniLab 3, or other similar minilab setup. Select samples can be tested for the formation of carbon fiber, to evaluate the effectiveness of the LSDCL techniques in the synthesis of coal tar pitch. The results of this testing can be used to optimize the processing conditions for the conversion of mesophase pitch to carbon fiber at any scale desired, including plant scale.

Figure 4:
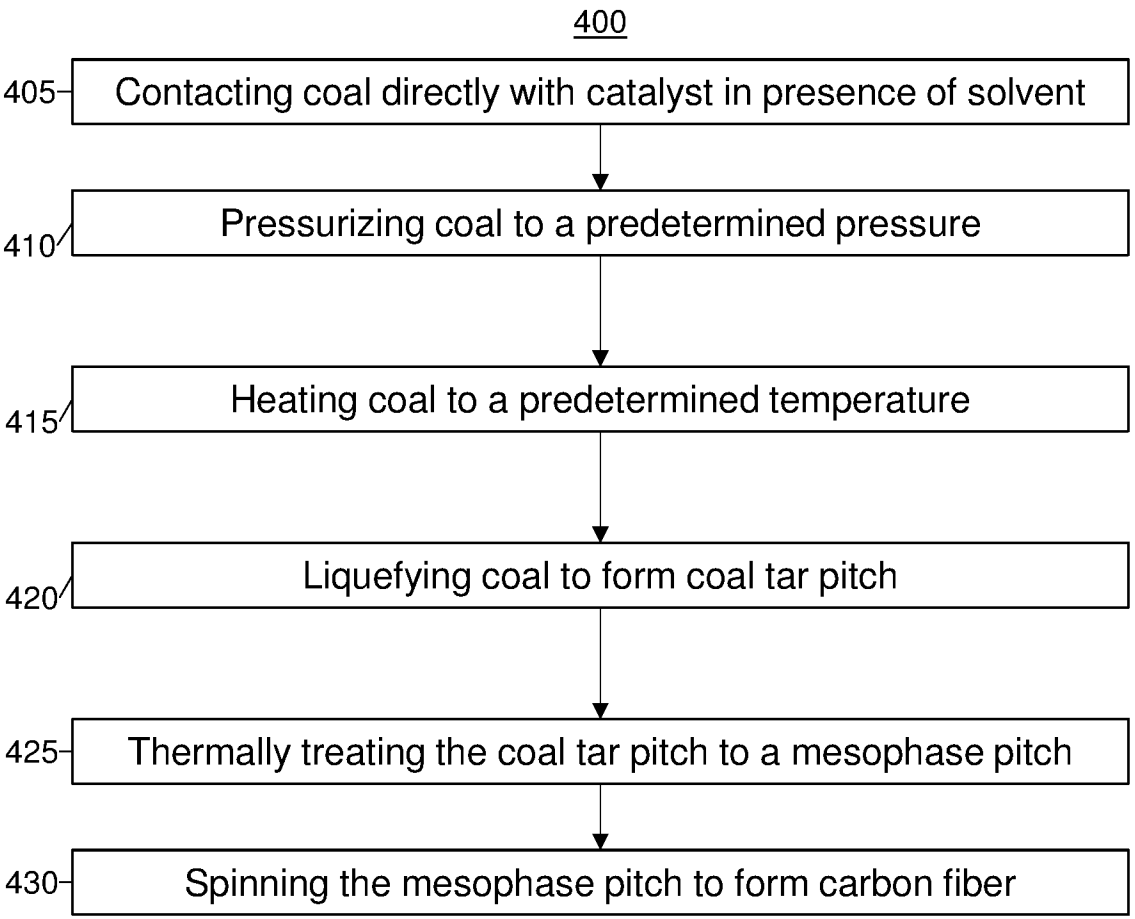
FIG. 4 is a process flow diagram of a method for processing coal, according to some examples.

FIG. 4 is a flow diagram of a method 400 for processing coal. The method 400 can provide LSDCL techniques used in the synthesis of coal tar pitch to dramatically increase coal tar pitch yields, especially from low-cost western United States coals which heretofore have not historically yielded high amounts of suitable coal tar pitch by other conventional means such high or low temperature pyrolysis. Achieving such cost reductions take advantage of a secure, plentiful domestic coal feedstock. The method 400 can also produce a high-quality carbon fiber precursor material from coal to significantly lower the production cost of carbon fibers. According to some examples, the method 400 can include an LSDCL process that is used to synthesize coal-tar-derived pitch, targeted for use as a carbon-fiber precursor. In some examples, the LSDCL process can be a continuous LSDCL process.

The method can include contacting coal directly with a catalyst in the presence of a solvent at block 405, pressurizing the coal to a predetermined pressure at block 410, heating the coal to a predetermined temperature at block 415, liquefying the coal to form coal tar pitch, at block 420, thermally treating the coal tar pitch to a mesophase pitch at block 425, and spinning the mesophase pitch to form carbon fiber at block 430. In some examples, blocks 405, 410, 415, 420, 425, and 430 of the method 400 can be performed in different orders, split into multiple acts, modified, supplemented, or combined. In some examples, one or more of the blocks 405, 410, 415, 420, 425, and 430 of the method 400 can be omitted from the method 400. Any of the blocks 405, 410, 415, 420, 425, and 430 can include using any of the direct liquefaction reactors and coal processing systems and related controllers disclosed herein. One or more of the blocks 405, 410, 415, 420, 425, and 430 of the method 400 can be caused by a controller, such as a controller 500 described below. In some examples, the method 400 can be at least partially carried out in or by a direct contact liquefaction reactor as described herein.

Block 405 can include contacting coal directly with a catalyst in the presence of a solvent. In some examples, the coal can comprise anthracite coal and/or coal extracted from Wyoming's Powder River Basin. The catalyst may include any catalyst described herein or known in the art, and the solvent may include any solvent described herein or known in the art. In some examples, a solvent can include one or more of N-Methyl-2-pyrrolidone (NMP), quinoline, fluorinert FC-71, silicone oils, phthalates such as dioctyl phthalate, syltherm 800, or any other suitable solvent or carrier. In some examples, the catalyst can be, but is on no way limited to a Lewis acid catalyst. In some examples, block 405 includes contacting coal directly with the catalyst in the presence of the solvent and added hydrogen ($H_2$).

At block 410 a predetermined pressure is exerted on the coal, for example in a reaction chamber. In some examples, block 410 includes pressurizing the coal in direct contact with the catalyst in the presence of the solvent to a predetermined pressure of about 1000 pounds per square inch absolute (psia) or less. Block 410 also can include pressurizing the coal that is in direct contact with the catalyst in the presence of the solvent and added hydrogen to the predetermined pressure. In some examples, block 410 can occur simultaneously with block 405. In some examples, block 410 includes pressurizing the coal in direct contact with the catalyst in the presence of the solvent to a predetermined pressure of about 975 psia or less, about 950 psia or less, about 925 psia or less, about 900 psia or less, about 875 psia or less, about 850 psia or less, about 825 psia or less, about 800 psia or less, about 775 psia or less, about 750 psia or less, about 725 psia or less, about 700 psia or less, about 675 psia or less, about 650 psia or less, about 625 psia or less, about 600 psia or less, about 575 psia or less, about 550 psia or less, about 525 psia or less, about 500 psia or less, about 475 psia or less, about 450 psia or less, about 425 psia or less, about 400 psia or less, about 375 psia or less, about 350 psia or less, about 350 psia to about 450 psia, about 400 psia to about 500 psia, about 450 psia to about 550 psia, about 500 psia to about 600 psia, about 550 psia to about 650 psia, about 600 psia to about 700 psia, about 650 psia to about 750 psia, about 700 psia to about 800 psia, about 750 psia to about 850 psia, about 800 psia to about 900 psia, about 850 psia to about 950 psia, about 900 psia to less than about 100 psia, about 350 psia to about 400 psia, about 400 psia to about 450 psia, about 450 psia to about 500 psia, about 500 psia to about 550 psia, about 550 psia to about 600 psia, about 600 psia to about 650 psia, about 650 psia to about 700 psia, about 700 psia to about 750 psia, about 750 psia to about 800 psia, about 800 psia to about 850 psia, about 850 psia to about 900 psia, about 900 psia to about 950 psia, about 950 psia to less than about 1000 psia, about 350 psia, about 375 psia, about 400 psia, about 425 psia, about 450 psia, about 475 psia, about 500 psia, about 525 psia, about 550 psia, about 575 psia, about 600 psia, about 625 psia, about 650 psia, about 675 psia, about 700 psia, about 725 psia, about 750 psia, about 775 psia, about 800 psia, about 825 psia, about 850 psia, about 875 psia, about 900 psia, about 925 psia, about 950 psia, or about 975 psia.

At block 415 the coal is heated to a predetermined temperature. In some examples, block 410 includes heating the coal in direct contact with the catalyst in the presence of the solvent to a predetermined temperature of about 380° C. or less. Block 415 can also include heating the coal that is in direct contact with the catalyst in the presence of the solvent and added hydrogen to the predetermined temperature. In some examples, block 415 can occur simultaneously with one or more other blocks, such as block 405 and 410. In some examples, block 415 includes heating the coal in direct contact with the catalyst in the presence of the solvent to a predetermined temperature of about 380° C. or less, about 375° C. or less, about 370° C. or less, about 365° C. or less, about 360° C. or less, about 355° C. or less, about 350° C. or less, about 325° C. or less, about 320° C. or less, about 315° C. or less, about 310° C. or less, about 305° C. or less, about 300° C. or less, about 295° C. or less, about 290° C. or less, about 285° C. or less, about 280° C. or less, about 275° C. or less, about 270° C. or less, about 265° C. or less, about 260° C. or less, about 255° C. or less, 250° C.

or less, about 245° C. or less, about 240° C. or less, about 235° C. or less, about 230° C. or less, about 225° C. or less, about 220° C. or less, about 215° C. or less, about 210° C. or less, about 205° C. or less, about 200° C. or less, about 200° C. to about 225° C., about 225° C. to about 250° C., about 250° C. to about 275° C., about 275° C. to about 300° C., about 300° C. to about 325° C., about 325° C. to about 350° C., about 350° C. to about 375° C., about 200° C. to about 210° C., about 210° C. to about 220° C., about 220° C. to about 230° C., about 230° C. to about 240° C., about 240° C. to about 250° C., about 250° C. to about 260° C., about 260° C. to about 270° C., about 270° C. to about 280° C., about 280° C. to about 290° C., about 290° C. to about 300° C., about 300° C. to about 310° C., about 310° C. to about 320° C., about 320° C. to about 330° C., about 330° C. to about 340° C., about 340° C. to about 350° C., about 350° C. to about 360° C., about 360° C. to about 370° C., about 370° C. to about 380° C., about 380° C., about 375° C., about 370° C., about 365° C., about 360° C., about 355° C., about 350° C., about 345° C., about 340° C., about 335° C., about 330° C., about 325° C., about 320° C., about 315° C., about 310° C., about 305° C., about 300° C., about 295° C., about 290° C., about 285° C., 280° C., about 275° C., about 270° C., about 265° C., about 260° C., about 255° C., about 250° C., about 245° C., about 240° C., about 235° C., about 230° C., about 225° C., about 220° C., about 215° C., about 210° C., about 205° C., or about 200° C.

In many examples, the method 400 includes pressurizing the coal to any one of the predetermined pressures described above while simultaneously heating the coal to any one of the predetermined temperatures described above, and while contacting the coal directly with the catalyst in the presence of the solvent and the added hydrogen. In some examples, block 420 includes liquefying the coal to form coal tar pitch. Although described as a separate process step, it should be understood that the liquification of the coal to form coal tar pitch can occur as a result of one or more of blocks 405, 410, and/or 415.

Block 425 includes thermally treating the coal tar pitch to a mesophase pitch. In some examples, block 425 includes thermally treating the coal tar pitch to a liquid crystal phase exhibiting anisotropic spheres of a mesophase pitch. In many examples block 425 can include one or more of the acts of filtration, heating, settling, and centrifuging.

Block 430 includes spinning the mesophase pitch to form carbon fiber. Once the mesophase pitch is formed, it can be formed into any number of carbon products such as, but not limited to, graphene, fullerene, diamond, and/or carbon fiber. However, for purposes of this disclosure, the mesophase pitch will be described as being used to form carbon fiber. In many examples, block 430 can include oxidation, carbonization, graphitization, surface treatment, sizing, and winding. The carbon fiber yield of the method 400 can be about 100 kg or more per ton of the coal contacted directly with the catalyst in the presence of the solvent. For example, the carbon fiber yield of the method 400 can be about 125 kg or more per ton of the coal, about 150 kg or more per ton of the coal, about 175 kg or more per ton of the coal, about 200 kg or more per ton of the coal, about 225 kg or more per ton of the coal, about 250 kg or more per ton of the coal, about 275 kg or more per ton of the coal, about 300 kg or more per ton of the coal, about 325 kg or more per ton of the coal, about 350 kg or more per ton of the coal, about 375 kg or more per ton of the coal, about 400 kg or more per ton of the coal, about 100 kg to about 150 kg per ton of the coal, about 150 kg to about 200 kg per ton of the coal, about 200 kg to about 250 kg per ton of the coal, about 250 kg to about 300 kg per ton of the coal, about 300 kg to about 350 kg per ton of the coal, about 350 kg to about 400 kg per ton of the coal, about 100 kg to about 200 kg per ton of the coal, about 200 kg to about 300 kg per ton of the coal, about 300 kg to about 400 kg per ton of the coal, about 125 kg per ton of the coal, about 150 kg per ton of the coal, about 175 kg per ton of the coal, about 200 kg per ton of the coal, about 225 kg per ton of the coal, about 250 kg per ton of the coal, about 275 kg per ton of the coal, about 300 kg per ton of the coal, about 325 kg or per ton of the coal, about 350 kg per ton of the coal, about 375 kg per ton of the coal, about 400 kg per ton of the coal contacted directly with the catalyst in the presence of the solvent according to block 405.

In some examples, the process steps described herein can efficiently produce mesophase pitch of a desired quality and composition from coal using temperatures that are low enough, and durations that are short enough to allow for the processes to be run in a continuous reactor. That is, any of the methods described herein can be continuously operated in one or more reactors or reaction vessels to produce a continuous output of mesophase pitch having desired properties from a continuous input of coal or another coal-derived precursor. In some examples, the parameters of the methods can be modified as described herein while the continuous process is occurring or being carried out. For example, the coal can be continuously evaluated as part of a continuous reaction process and the process parameters such as catalyst amount, temperature, or time, can be adjusted on the fly during the continuous reaction process. This ability to continuously monitor and adjust reaction and parameters during a continuous reaction process can allow for the continuous formation of mesophase pitch having desired properties while accounting for variations in the quality of the incoming coal or other coal-derived feedstock. This would, in turn, reduce the cost of the mesophase pitch by an order of magnitude, thereby significantly reducing the cost of carbon products formed therefrom.

In some examples, the mesophase pitch formed by the processes described herein can be used as a precursor to form allotropes of carbon, including covalently bonded monolayers of carbon atoms arranged in hexagonal or aromatic structures. In some examples, the mesophase pitch formed by the processes described herein can be used as a precursor to produce carbon sheets that have delocalized $sp^2$ hybridized pi-bonding within the sheet. By processing coal as described herein, mesophase pitch can be produced that includes properties that allow it to serve as a precursor for the easy and efficient formation of desired carbon products. As a result, the mesophase pitch including the desired component molecules at desired purities can allow for the formation of carbon products with desired properties. For example, mesophase pitch formed from coal by the processes described herein can be used to produce graphene or other carbon products that have thermal conductivities up to about 5300 W/m·K, that have electrical conductivities similar to conductivities achieved with electron tunneling, that have mechanical strengths over 100 gigapascals (GPa), that have moduli over 2 terapascals (TPa), and that can exhibit up to 20% elongation.

Figure 5:
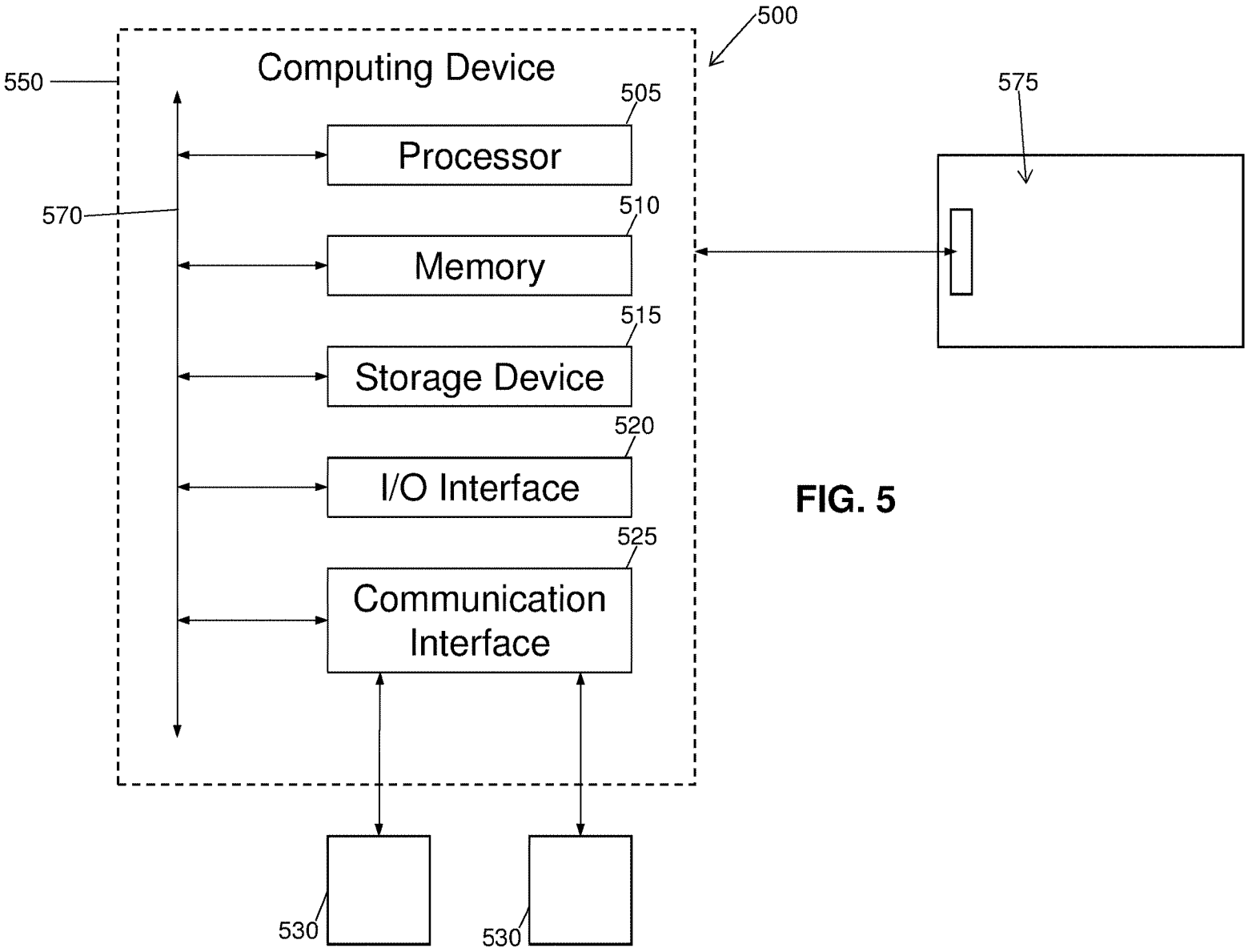
FIG. 5 is a schematic of a controller, according to some examples.

Any of the example systems disclosed herein can be used to carry out any of the example methods disclosed herein, such as using a controller. FIG. 5 is a schematic of a controller 500 for executing any of the example methods disclosed herein and a direct liquefaction reactor 575, according to some examples. The direct liquefaction reactor 575 may include any direct liquefaction reactor known in the art, or described or referenced herein. The controller 500 can be configured to implement any of the example methods disclosed herein, such as the method 400. The controller 500 can include at least one computing device 550. The at least one computing device 550 is an exemplary computing device that can be configured to perform one or more of the acts described above, such as the method 400. The at least one computing device 550 can include one or more servers, one or more computers (e.g., desk-top computer, lap-top computer), or one or more mobile computing devices (e.g., smartphone, tablet, etc.). The computing device 550 can comprise at least one processor 505, memory 510, a storage device 515, an input/output ("I/O") device/interface 520, and a communication interface 525. While an example computing device 550 is shown in FIG. 5, the components illustrated in FIG. 5 are not intended to be limiting of the controller 500 or computing device 550. Additional or alternative components can be used in some examples. Further, in some examples, the controller 500 or the computing device 550 can include fewer components than those shown in FIG. 5. For example, the controller 500 may not include the one or more additional computing devices 530. In some examples, the at least one computing device 550 can include a plurality of computing devices, such as a server farm, computational network, or cluster of computing devices. Components of computing device 550 shown in FIG. 5 are described in additional detail below.

In some examples, the processor(s) 505 includes hardware for executing instructions (e.g., instructions for carrying out one or more portions of any of the methods disclosed herein), such as those making up a computer program. For example, to execute instructions, the processor(s) 505 can retrieve (or fetch) the instructions from an internal register, an internal cache, the memory 510, or a storage device 515, and decode and execute them. In particular examples, the processor(s) 505 can include one or more internal caches for data. As an example, the processor(s) 505 can include one or more instruction caches, one or more data caches, and one or more translation lookaside buffers (TLBs). Instructions in the instruction caches can be copies of instructions in memory 510 or storage device 515. In some examples, the processor 505 can be configured (e.g., include programming stored thereon or executed thereby) to carry out one or more portions of any of the example methods disclosed herein.

In some examples, the processor 505 is configured to perform any of the acts disclosed herein such as in method 400 or cause one or more portions of the computing device 550 or controller 500 to perform at least one of the acts disclosed herein. Such configuration can include one or more operational programs (e.g., computer program products) that are executable by the at least one processor 505.

For example, the processor 505 can be configured to cause the controller 500 to operate the direct liquefaction reactor 575 to pressurize the coal in direct contact with a catalyst in the presence of a solvent to a predetermined pressure of about 1000 psia or less. In some embodiments, the processor 505 is be configured to cause the controller 500 to operate the direct liquefaction reactor 575 to pressurize the coal in direct contact with the catalyst in the presence of the solvent to a predetermined pressure of about 975 psia or less, about 950 psia or less, about 925 psia or less, about 900 psia or less, about 875 psia or less, about 850 psia or less, about 825 psia or less, about 800 psia or less, about 775 psia or less, about 750 psia or less, about 725 psia or less, about 700 psia or less, about 675 psia or less, about 650 psia or less, about 625 psia or less, about 600 psia or less, about 575 psia or less, about 550 psia or less, about 525 psia or less, about 500 psia or less, about 475 psia or less, about 450 psia or less, about 425 psia or less, about 400 psia or less, about 375 psia or less, about 350 psia or less, about 350 psia to about 450 psia, about 400 psia to about 500 psia, about 450 psia to about 550 psia, about 500 psia to about 600 psia, about 550 psia to about 650 psia, about 600 psia to about 700 psia, about 650 psia to about 750 psia, about 700 psia to about 800 psia, about 750 psia to about 850 psia, about 800 psia to about 900 psia, about 850 psia to about 950 psia, about 900 psia to less than about 100 psia, about 350 psia to about 400 psia, about 400 psia to about 450 psia, about 450 psia to about 500 psia, about 500 psia to about 550 psia, about 550 psia to about 600 psia, about 600 psia to about 650 psia, about 650 psia to about 700 psia, about 700 psia to about 750 psia, about 750 psia to about 800 psia, about 800 psia to about 850 psia, about 850 psia to about 900 psia, about 900 psia to about 950 psia, about 950 psia to less than about 1000 psia, about 350 psia, about 375 psia, about 400 psia, about 425 psia, about 450 psia, about 475 psia, about 500 psia, about 525 psia, about 550 psia, about 575 psia, about 600 psia, about 625 psia, about 650 psia, about 675 psia, about 700 psia, about 725 psia, about 750 psia, about 775 psia, about 800 psia, about 825 psia, about 850 psia, about 875 psia, about 900 psia, about 925 psia, about 950 psia, or about 975 psia.

The processor 505 also can be configured to operate the direct liquefaction reactor 575 to heat the coal in direct contact with the catalyst in the presence of the solvent to a predetermined temperature of about 380° C. or less. In some embodiments, the processor is configured to operate the direct liquefaction reactor 575 to heat the coal in direct contact with the catalyst in the presence of the solvent to a predetermined temperature of about 380° C. or less, about 375° C. or less, about 370° C. or less, about 365° C. or less, about 360° C. or less, about 355° C. or less, about 350° C. or less, about 325° C. or less, about 320° C. or less, about 315° C. or less, about 310° C. or less, about 305° C. or less, about 300° C. or less, about 295° C. or less, about 290° C. or less, about 285° C. or less, about 280° C. or less, about 275° C. or less, about 270° C. or less, about 265° C. or less, about 260° C. or less, about 255° C. or less, 250° C. or less, about 245° C. or less, about 240° C. or less, about 235° C. or less, about 230° C. or less, about 225° C. or less, about 220° C. or less, about 215° C. or less, about 210° C. or less, about 205° C. or less, about 200° C. or less, about 200° C. to about 225° C., about 225° C. to about 250° C., about 250° C. to about 275° C., about 275° C. to about 300° C., about 300° C. to about 325° C., about 325° C. to about 350° C., about 350° C. to about 375° C., about 200° C. to about 210° C., about 210° C. to about 220° C., about 220° C. to about 230° C., about 230° C. to about 240° C., about 240° C. to about 250° C., about 250° C. to about 260° C., about 260° C. to about 270° C., about 270° C. to about 280° C., about 280° C. to about 290° C., about 290° C. to about 300° C., about 300° C. to about 310° C., about 310° C. to about 320° C., about 320° C. to about 330° C., about 330° C. to about 340° C., about 340° C. to about 350° C., about 350° C. to about 360° C., about 360° C. to about 370° C., about 370° C. to about 380° C., about 380° C., about 375° C., about 370° C., about 365° C., about 360° C., about 355° C., about 350° C., about 345° C., about 340° C., about 335° C., about 330° C., about 325° C., about 320° C., about 315° C., about 310° C., about 305° C., about 300° C., about 295° C., about 290° C., about 285° C., 280° C., about 275° C., about 270° C., about 265° C., about 260° C., about 255° C., about 250° C., about 245° C., about 240° C., about 235° C., about 230° C., about 225° C., about 220° C., about 215° C., about 210° C., about 205° C., or about 200° C.

In many examples, the processor 505 is configured to operate the direct liquefaction reactor 575 at any combination of the predetermined pressures and predetermined temperatures described above. The processor 505 also can be configured to operate the direct liquefaction reactor 575 to liquefy the coal to form a coal tar pitch.

The at least one computing device 550 (e.g., a server) can include at least one memory storage medium (e.g., memory 510 and/or storage device 515). The computing device 550 can include memory 510, which is operably coupled to the processor(s) 505. The memory 510 can be used for storing data, metadata, and programs for execution by the processor(s) 505. The memory 510 can include one or more of volatile and non-volatile memories, such as Random Access Memory (RAM), Read Only Memory (ROM), a solid state disk (SSD), Flash, Phase Change Memory (PCM), or other types of data storage. The memory 530 can be internal or distributed memory.

The computing device 550 can include the storage device 515 having storage for storing data or instructions. The storage device 515 can be operably coupled to the at least one processor 505. In some examples, the storage device 515 can comprise a non-transitory memory storage medium, such as any of those described above. The storage device 515 (e.g., non-transitory storage medium) can include a hard disk drive (HDD), a floppy disk drive, flash memory, an optical disc, a magneto-optical disc, magnetic tape, or a Universal Serial Bus (USB) drive or a combination of two or more of these. Storage device 515 can include removable or non-removable (or fixed) media. Storage device 515 can be internal or external to the computing device 550. In some examples, storage device 515 can include non-volatile, solid-state memory. In some examples, storage device 515 can include read-only memory (ROM). Where appropriate, this ROM can be mask programmed ROM, programmable ROM (PROM), erasable PROM (EPROM), electrically erasable PROM (EEPROM), electrically alterable ROM (EAROM), or flash memory or a combination of two or more of these. In some examples, one or more portions of the memory 510 and/or storage device 515 (e.g., memory storage medium(s)) can store one or more databases thereon.

In some examples, computer-readable instructions can be stored in a memory storage medium such as one or more of the at least one processor 505 (e.g., internal cache of the processor), memory 510, or the storage device 515. In some examples, the at least one processor 505 can be configured to access (e.g., via bus 570) the memory storage medium(s) such as one or more of the memory 510 or the storage device 515. For example, the at least one processor 505 can receive and store the data (e.g., look-up tables) as a plurality of data points in the memory storage medium(s). The at least one processor 505 can execute programming stored therein adapted access the data in the memory storage medium(s). For example, the at least one processor 505 can access one or more look-up tables in the memory storage medium(s) such as memory 510 or storage device 515.

The computing device 550 also includes one or more I/O devices/interfaces 520, which are provided to allow a user to provide input to, receive output from, and otherwise transfer data to and from the computing device 550. These I/O devices/interfaces 520 can include a mouse, keypad or a keyboard, a touch screen, camera, optical scanner, network interface, web-based access, modem, a port, other known I/O devices or a combination of such I/O devices/interfaces 520. The touch screen can be activated with a stylus or a finger.

The I/O devices/interfaces 520 can include one or more devices for presenting output to a user, including, but not limited to, a graphics engine, a display (e.g., a display screen or monitor), one or more output drivers (e.g., display drivers), one or more audio speakers, and one or more audio drivers. In certain examples, I/O devices/interfaces 520 are configured to provide graphical data to a display for presentation to a user. The graphical data can be representative of one or more graphical user interfaces and/or any other graphical content as can serve a particular implementation.

The computing device 550 can further include a communication interface 525. The communication interface 525 can include hardware, software, or both. The communication interface 525 can provide one or more interfaces for communication (such as, for example, packet-based communication) between the computing device 550 and one or more additional computing devices 530 or one or more networks. For example, communication interface 525 can include a network interface controller (NIC) or network adapter for communicating with an Ethernet or other wire-based network or a wireless NIC (WNIC) or wireless adapter for communicating with a wireless network, such as a Wi-Fi.

Any suitable network and any suitable communication interface 525 can be used. For example, computing device 550 can communicate with an ad hoc network, a personal area network (PAN), a local area network (LAN), a wide area network (WAN), a metropolitan area network (MAN), or one or more portions of the Internet or a combination of two or more of these. One or more portions of one or more of these networks can be wired or wireless. As an example, one or more portions of controller 500 or computing device 550 can communicate with a wireless PAN (WPAN) (such as, for example, a BLUETOOTH WPAN), a Wi-Fi network, a Wi-MAX network, a cellular telephone network (such as, for example, a Global System for Mobile Communications (GSM) network), or other suitable wireless network or a combination thereof. Computing device 550 can include any suitable communication interface 525 for any of these networks, where appropriate.

The computing device 550 can include a bus 570. The bus 570 can include hardware, software, or both that couples components of computing device 550 to each other. For example, bus 570 can include an Accelerated Graphics Port (AGP) or other graphics bus, an Enhanced Industry Standard Architecture (EISA) bus, a front-side bus (FSB), a HYPERTRANSPORT (HT) interconnect, an Industry Standard Architecture (ISA) bus, an INFINIBAND interconnect, a low-pin-count (LPC) bus, a memory bus, a Micro Channel Architecture (MCA) bus, a Peripheral Component Interconnect (PCI) bus, a PCI-Express (PCIe) bus, a serial advanced technology attachment (SATA) bus, a Video Electronics Standards Association local (VLB) bus, or another suitable bus or a combination thereof.

It should be appreciated that any of the examples of acts described herein, such as in the method 400 can be performed by and/or at the computing device 550. In some examples, one or more of the at least one processor 505 (e.g., internal cache of the processor), memory 510, or the storage device 515 include computer-executable instruction that, when executed by the processor 505 cause the controller 500 to operate the direct liquefaction reactor 575 to pressurize the coal in direct contact with a catalyst in the presence of a solvent to any of the predetermined pressures described above, operate the direct liquefaction reactor 575 to heat the coal in direct contact with the catalyst in the presence of the solvent to any of predetermined temperatures described above and at any of the predetermined pressures described above, and operate the direct liquefaction reactor 575 to liquefy the coal to form a coal tar pitch.

As used herein, the term "about" or "substantially" refers to an allowable variance of the term modified by "about" or "substantially" by ±10% or ±5%. Further, the terms "less than," "or less," "greater than," "more than," or "or more" include, as an endpoint, the value that is modified by the terms "less than," "or less," "greater than," "more than," or "or more."

While various aspects and embodiments have been disclosed herein, other aspects and embodiments are contemplated. The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not target to be exhaustive or to limit the embodiments to the precise forms disclosed. It will be apparent to one of ordinary skill in the art that many modifications and variations are possible in view of the above teachings.

Various inventions have been described herein with reference to certain specific embodiments and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including" and "having" come as used in the specification and claims shall have the same meaning as the term "comprising."

What is claimed is:

1. A method of processing coal, comprising:

analyzing an amount of coal with an auto-clave apparatus to assess the reactivity of the amount of coal;

removing the amount of coal from the auto-clave apparatus and washing the auto-clave apparatus to form a filter cake of ash and insoluble organic matter from a filter wash material;

contacting the amount of coal directly with a catalyst in the presence of a solvent and hydrogen gas added to the coal, wherein the hydrogen gas is provided by gasifying coal, biomass, or a liquefaction residue;

exerting a predetermined pressure between about 500 pounds per square inch absolute (psia) and about 1000 pounds per square inch absolute (psia) on the amount of coal and the solvent, the hydrogen gas added to exert the predetermined pressure and break down the amount of coal into soluble products;

heating the amount of coal and the solvent to a predetermined temperature of about 380° C. or less; and liquefying at least some of the amount of coal to form a coal tar pitch.

2. The method of claim 1, wherein the predetermined pressure is one of about 900, about 800, about 700, about 600, or about 500 psia.

3. The method of claim 2, wherein the predetermined temperature is about 375° C. or less.

4. The method of claim 2, wherein the predetermined temperature is about 365° C. or less.

5. The method of claim 2, wherein the predetermined temperature is about 355° C. or less.

6. The method of claim 1, further comprising thermally treating the coal tar pitch to a liquid crystal phase exhibiting anisotropic spheres of a mesophase pitch.

7. The method of claim 6, further comprising spinning the mesophase pitch to form carbon fibers.

8. The method of claim 6, wherein a carbon fiber yield of the method is about 200 kg or more per ton of the amount of coal contacted directly with the catalyst in the presence of the solvent.

9. The method of claim 6, wherein a carbon fiber yield of the method is about 300 kg or more per ton of the amount of coal contacted directly with the catalyst in the presence of the solvent.

* * * * *